US007327331B2

(12) United States Patent
Kang et al.

(10) Patent No.: US 7,327,331 B2
(45) Date of Patent: Feb. 5, 2008

(54) APPARATUS FOR GENERATING RAMP RESET WAVEFORM FOR DISPLAY PANEL AND DESIGN METHOD THEREFOR

(75) Inventors: Jeong-il Kang, Yongin-si (KR); Young-sun Kim, Suwon-si (KR); Chung-wook Roh, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 591 days.

(21) Appl. No.: 11/003,321

(22) Filed: Dec. 6, 2004

(65) Prior Publication Data

US 2005/0140590 A1 Jun. 30, 2005

(30) Foreign Application Priority Data

Dec. 5, 2003 (KR) ..... 10-2003-0087939

(51) Int. Cl.
*G09G 3/28* (2006.01)

(52) U.S. Cl. ..... 345/60; 345/68

(58) Field of Classification Search ..... 345/60–71; 315/169.1, 169.2, 169.3, 169.4; 313/584, 313/585

See application file for complete search history.

(56) References Cited

U.S. PATENT DOCUMENTS 4,935,706 A * 6/1990 Schenberg ..... 331/11
5,594,377 A * 1/1997 Choi et al. ..... 327/278
6,664,821 B2 * 12/2003 De Haas et al. ..... 327/108
2002/0047552 A1 4/2002 Sano et al.
2002/0122016 A1 9/2002 Iwasa et al.
2002/0149404 A1 * 10/2002 De Haas et al. ..... 327/112

FOREIGN PATENT DOCUMENTS

JP 2002-328649 A 11/2002
KR 2002-0088176 A 11/2002
KR 2003-0046849 A 6/2003

* cited by examiner

*Primary Examiner*—Nitin I. Patel
(74) *Attorney, Agent, or Firm*—Sughrue Mion, PLLC

(57) ABSTRACT

A ramp reset waveform generating apparatus in a display panel driving apparatus for a display panel includes a current source which is connected to a first electrode sustain circuit of the display panel through a first terminal of the current source, and generates a current corresponding to a predetermined reference current; a first switching unit which switches current flow between a second terminal of the current source and a first electrode terminal of the display panel; and a second switching unit which switches current flow between the second terminal of the current source and a second electrode terminal of the display panel, wherein, in a reset period, a ramp reset waveform is generated in the first electrode terminal and the second electrode terminal by the charge or discharge process of the display panel by the current generated in the current source according to a predetermined switching sequence.

14 Claims, 5 Drawing Sheets

APPARATUS FOR GENERATING RAMP RESET WAVEFORM FOR DISPLAY PANEL AND DESIGN METHOD THEREFOR

This application claims priority from Korean Patent Application No. 2003-87939, filed on Dec. 5, 2003, in the Korean Intellectual Property Office, the disclosure of which is incorporated herein in its entirety by reference.

BACKGROUND OF THE INVENTION

1. Field of the Invention

The present invention relates to a display panel driving apparatus and a design method therefor and, more particularly, to a ramp reset waveform generation apparatus of a display panel which efficiently generates a ramp reset waveform of a plasma display panel, and a design method therefor.

2. Description of the Related Art

In general, a plasma display panel (PDP) is a flat panel display for displaying characters or images using plasma generated by gas discharge. Depending on the size of the PDP, pixels ranging from several hundreds of thousands to more than millions are arranged in a matrix form.

The basic operation of a PDP driving circuit is explained in U.S. Pat. No. 4,866,349.

The driving sequence of a PDP is divided into a reset period, an address discharge period, and a sustain discharge period. In the reset period, all cells are discharged and, at the same time, wall charges are erased such that the display history is erased. In the address discharge period, discharge cells are selected from a matrix formed by the combination of row/column electrodes so that address discharge is formed. In the sustain discharge period, sustain discharge and energy recovery are repeatedly performed only in cells forming wall charges to display images.

More specifically, the reset period includes a wall charge erase period for which wall charges that are remaining, after finishing the sustain discharge of the previous field, are erased, and a wall charge rearrangement period initializing the panel for addressing of a current field.

Waveforms used for resetting in a PDP panel include an exponential waveform, a square waveform, a ramp waveform, and so on. Using a square-waveform pulse to reset has an advantage in that the implementation of a driving circuit is very simple. However, the quality of the contrast ratio is degraded due to the strong discharge generation. Using an exponential waveform to reset has other drawbacks, in that, the resetting time is long and an optimal reset is difficult to achieve. Because an exponential waveform reset is performed by charging the capacitance of a panel through a resistor, heat is generated and efficiency degrades due to the power consumed by the resistor.

Ramp waveform reset compensates for these problems and, at present, is the most widely used resetting function in PDP driving circuits.

FIG. 1 is a schematic diagram of a prior art structure of an alternating current (AC) PDP driving system implementing a reset function using a ramp waveform, and FIG. 2 shows the driving waveforms as applied to electrodes X and Y of a PDP.

The operation of ramp circuits A, B and C shown in FIG. 1 are basically identical and, except for devices with auxiliary purposes, can be diagramed as illustrated in FIG. 3.

The capacitance of the panel is denoted by $C_p$, and it is assumed that the initial voltage across $C_p$ is 0V. A power source $V_+$ determines the final value of a ramp waveform, for example, $V_E$ or $V_{SET}$. The power source $V_+$ determines only the final value of the ramp and is independent to the generation of the ramp waveform. The power source $V_+$ charges capacitor $C_R$ before the ramp generation signal $V_G$ is applied. If voltage is applied to $V_G$, a portion of current $i_R$ flows into the gate of MOSFET $M_R$ and increases gate-source voltage $V_{GS}$. The remaining portion of current $i_R$ flows into capacitor $C_R$. Once enough charge has accumulated in the gate of $M_R$ and $V_{GS}$ exceeds a threshold voltage $V_{TH}$, $M_R$ exits a cut-off state and current $i_D$ begins to rapidly increase and may be represented as a quadratic function. At this time, the charging of $C_P$ is performed at full scale. Once the rate of charging of $C_P$ by current $i_D-i_R$ equals the rate of discharging of $C_R$ by current $i_R-i_G$, $V_{GS}$ will be in equilibrium. If $V_{GS}$ is in equilibrium, drain current $i_D$ of $M_R$ is maintained and, at the same time, other currents on the circuit are maintained such that the voltage across $C_P$ increases linearly. If drain current $i_D$ temporarily increases and $C_P$ charges faster than the discharge rate of $C_R$, $V_{GS}$ will decrease and the drain current $i_D$ will again decrease such that the rate of the voltage increase of $C_P$ is reduced. Also, if $V_{GS}$ decreases, a current flowing into $C_R$ will increase and the discharge rate of $C_R$ will increase such that the rate of change of the voltages across $C_P$ and $C_R$ are maintained identically. The value of resistor RG determines a normal state value of $V_{GS}$ and, by adjusting resister $R_G$, the slope of the voltage waveform across $C_P$ can be adjusted.

In the circuit structure of FIG. 3, MOSFET $M_R$ does not work as a switching device but as a voltage-controlled current source, which plays the role of a variable resistor. Therefore, efficiency is degraded due to heat generation and a heat radiation plate is required. In addition, ramp generation circuits are allocated for each ramp waveform, and respective power sources are required for the final values of different ramp waveforms. Thus, the system structure is complicated, which increases the cost of materials for manufacturing.

SUMMARY OF THE INVENTION

The present disclosure provides a ramp reset waveform generation apparatus for generating a ramp reset waveform in a display panel by using one current source and two switching devices, and a design method therefor.

According to an aspect of the present invention, a ramp reset waveform generating apparatus in a display panel driving apparatus for a display panel comprises a current source which is connected to a first electrode sustain circuit of the display panel through a first terminal of the current source and generates a current corresponding to a predetermined reference current; a first switching unit which switches current flow between a second terminal of the current source and a first electrode terminal of the display panel; and a second switching unit which switches current flow between the second terminal of the current source and a second electrode terminal of the display panel, wherein, in a reset interval, a ramp reset waveform is generated in the first electrode terminal of the display panel and the second electrode terminal of the display panel by a charge or a discharge process of the display panel by the current generated in the current source according to a predetermined switching sequence.

According to another aspect of the present invention, a method for designing a plurality of ramp waveform generation apparatuses used in a reset interval of a display panel driving apparatus of a display panel, comprises arranging a current source for generating a current corresponding to a reference current, and a plurality of switching devices for determining a flow path of a current, generated in the current source, in the circuit level of the display panel driving apparatus; determining a current flow path so that, during a predetermined ramp waveform generation interval, charging or discharging the display panel occurs by the current generated in the current source according to a predetermined switching sequence such that a ramp voltage is generated in a first or second electrode of the display panel.

BRIEF DESCRIPTION OF THE DRAWINGS

The above and other features and advantages of the present invention will become more apparent by describing in detail exemplary embodiments thereof with reference to the attached drawings in which.

DESCRIPTION OF ILLUSTRATIVE, NON-LIMITING EMBODIMENTS OF THE INVENTION

Figure 4:
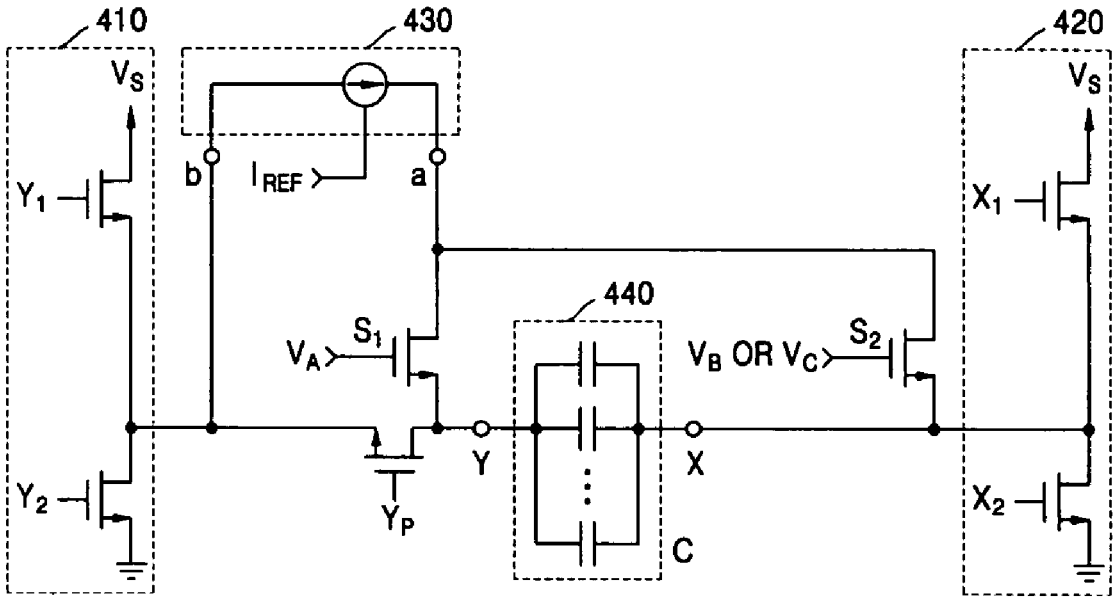
FIG. 4 is a diagram of a plasma display panel driving system employing a ramp reset waveform generation apparatus of a display panel consistent with the present invention.

In FIG. 4, a display panel driving system employing a ramp reset waveform generation apparatus of a display panel consistent with the present invention comprises a Y electrode sustain circuit 410, an X electrode sustain circuit 420, a current source 430, a PDP panel 440, and MOSFET switches $S_1$, $S_2$, and $Y_P$.

In the system structure, one current source 430 and two MOSFET switches $S_1$ and $S_2$ are used to generate each ramp waveform in a reset period of the display panel.

Figure 2:
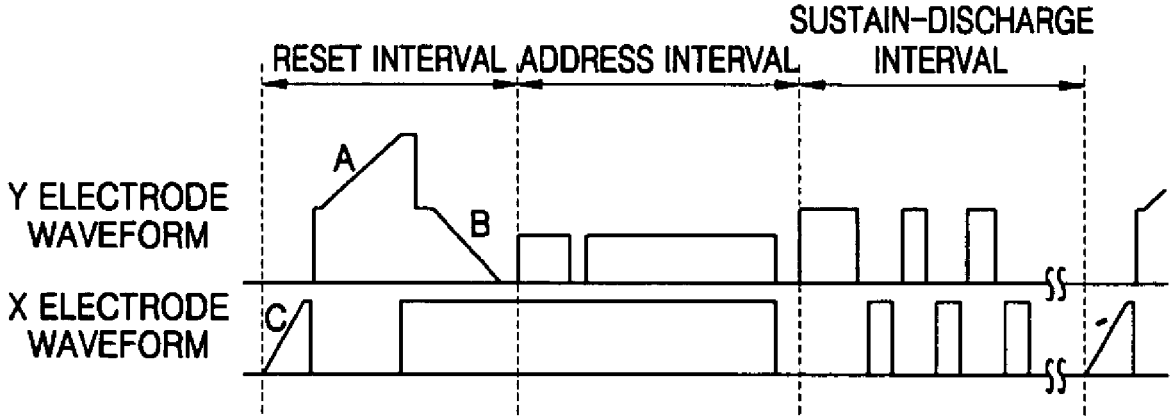
FIG. 2 (PRIOR ART)
FIG. 2 shows driving waveforms of X and Y electrodes of a plasma display panel executing a reset by a ramp waveform.
Figure 3:
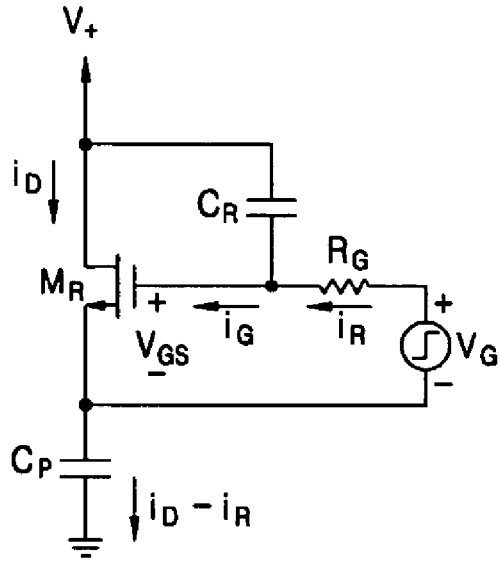
FIG. 3 (PRIOR ART)
FIG. 3 is a diagram of the circuit structure explaining the operations of ramp circuits A, B and C shown in FIG. 1.

The operation principles generating ramp waveforms A, B and C in the reset period shown in FIG. 2 will now be explained.

1) Ramp A Waveform Generation Mode

Figure 7A:
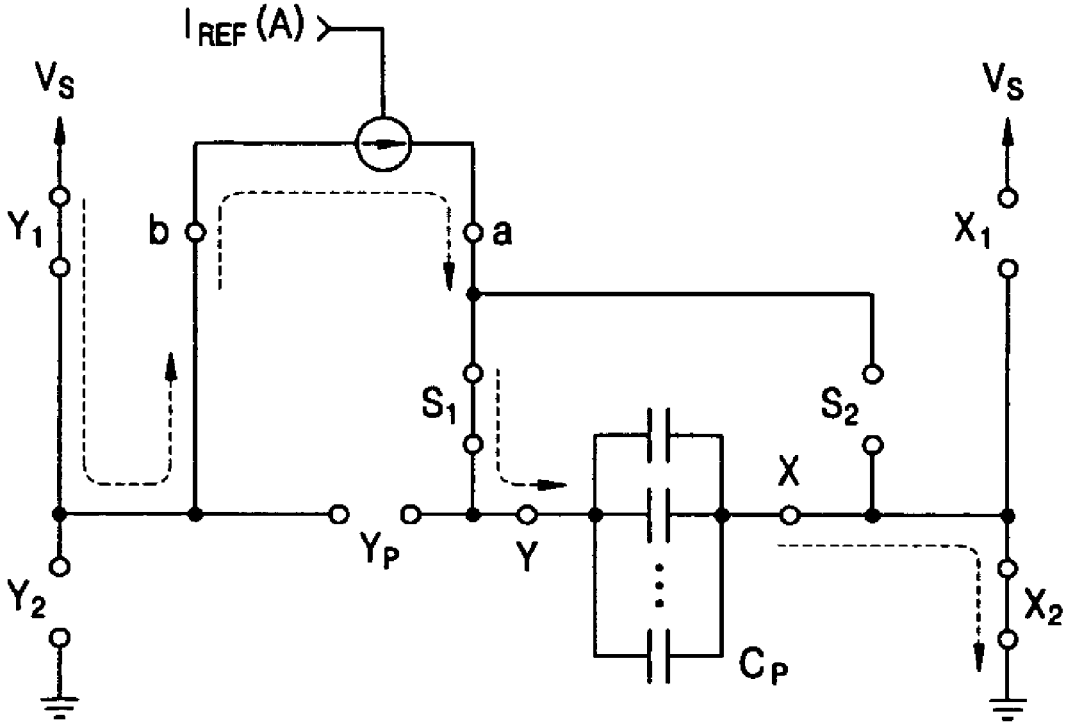
FIGS. 7A, 7B and 7C are diagrams of equivalent circuits and current flow paths for respective modes generating ramp waveforms.

In this mode, the X electrode of the panel is grounded, and, in order to increase the voltage of the Y electrode in a predetermined slope from $V_S$, switch $Y_1$ is turned on, switch $Y_2$ is turned off, switch $X_1$ is turned off and switch $X_2$ is turned on. In this state, switch $Y_P$ is turned off, switch $S_1$ is turned on, and switch $S_2$ is turned off, and reference current $I_{REF}$(A) (FIG. 7A) is applied to the current source 430. The equivalent circuit and current flow path are shown in FIG. 7A for this state.

If the voltage of the Y electrode reaches a target voltage (for example, $V_{SET}$), reference current $I_{REF}$(A) is set to zero (0) so that the voltage of the Y electrode does not increase further. Accordingly, the voltage generated in the Y electrode has the voltage waveform of ramp A shown in FIG. 2. The slope of the ramp A waveform becomes $I_{REF}(A)/C_P$ and the time for the voltage of the Y electrode to increase to $V_{SET}$ is $V_S C_P/I_{REF}(A)$.

2) Ramp B Waveform Generation Mode

Figure 7B:
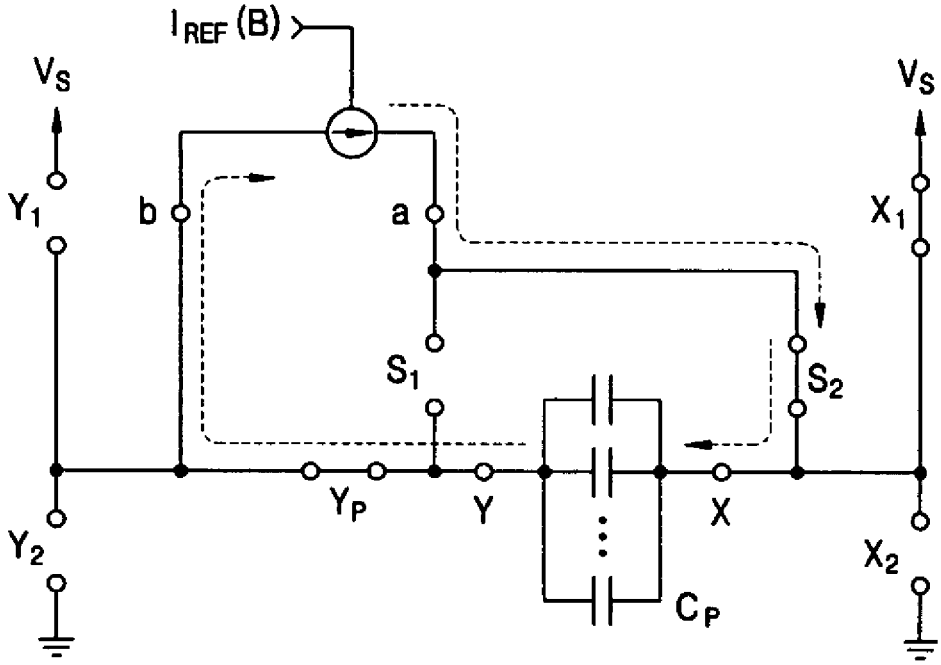

In this mode, switch $X_1$ is turned on and the voltage of the X electrode is fixed to $V_S$ and the remaining sustain switches $Y_1$, $Y_2$, and $X_2$ are turned off. While switch $S_1$ is turned off, switch $Y_P$ is turned on, switch $S_2$ is turned on and reference current $I_{REF}$(B) (FIG. 7B) is applied to the current source 430. Then, the panel is discharged through the Y electrode using the current flow path shown in FIG. 7B.

Accordingly, while the X electrode of the panel is fixed to $V_S$, the voltage of the Y electrode has a ramp B waveform with a predetermined slope from $V_S$ to zero (0). At this time, the slope of the ramp B waveform is $I_{REF}(B)/C_P$ and the time for the voltage of the Y electrode to become zero (0) is $V_S C_P/I_{REF}(B)$.

3) Ramp C Waveform Generation Mode

Figure 7C:
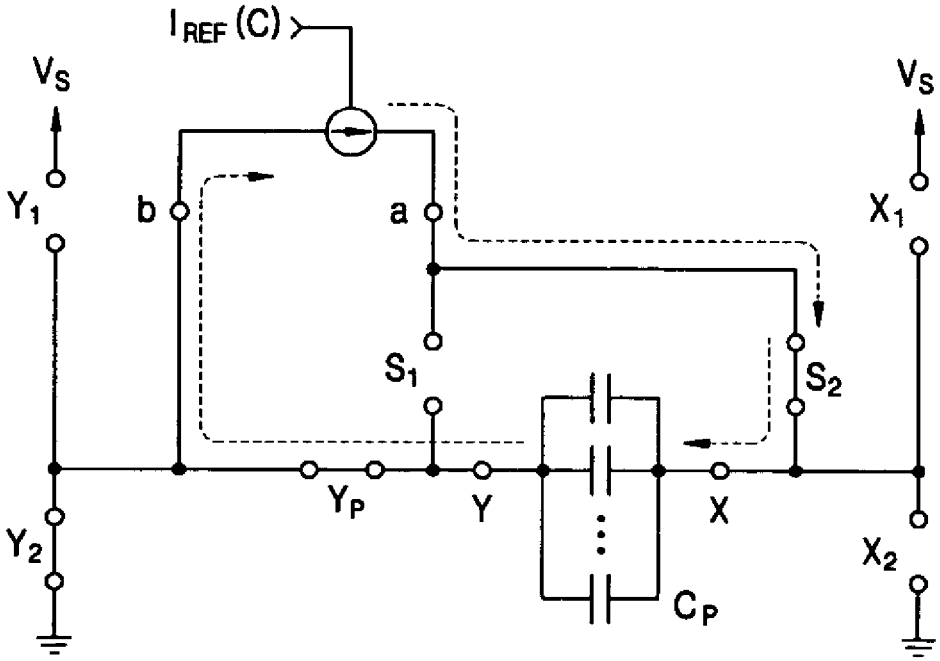

In this mode, switch $Y_2$ is turned on and the grounding of the Y electrode of the panel is maintained and the remaining sustain switches $Y_1$, $X_1$, and $X_2$ are turned off. In this state, switches $Y_P$ and $S_2$ are turned on, switch $S_1$ is turned off and reference current $I_{REF}$(C) (FIG. 7C) is applied to the current source 430, then the current flows through a path as shown in FIG. 7C and the voltage of the X electrode becomes a ramp C waveform increasing linearly from zero (0). If the voltage of the X electrode becomes a target voltage (for example, $V_E$), current $I_{REF}$(C) is set to zero (0) so that the voltage at the X electrode stops increasing. The slope of the ramp C waveform is $I_{REF}(C)/C_P$ and the time for the voltage of the X electrode to become $V_E$ is $V_S C_P/I_{REF}(C)$.

As shown in the circuit operations described above, ramp waveforms A, B and C are generated at the X or Y electrode of the PDP panel 440 in a reset period.

In the remaining period, excluding the reset period, ramp waveforms are not necessary. Accordingly, in order to prevent the ramp waveform generation circuit from affecting the display panel driving circuit, switches $S_1$ and $S_2$ are turned off and switch $Y_P$ is turned on.

Since switch $S_1$ is turned on only in the ramp A waveform generation mode, a ramp A generation signal $V_A$, as applied in a conventional ramp generation circuit, is used to drive the switch. Since switch $S_2$ is turned on in the ramp B waveform generation mode and the ramp C waveform generation mode, an OR operation of ramp generation signal $V_B$ and $V_C$ is used to drive the switch.

In order to generate ramp waveforms A, B and C having different slopes by using one current source 430, analog reference currents $I_{REF}$(A), $I_{REF}$(B), and $I_{REF}$(C) corresponding to the respective slopes are used.

Figure 5:
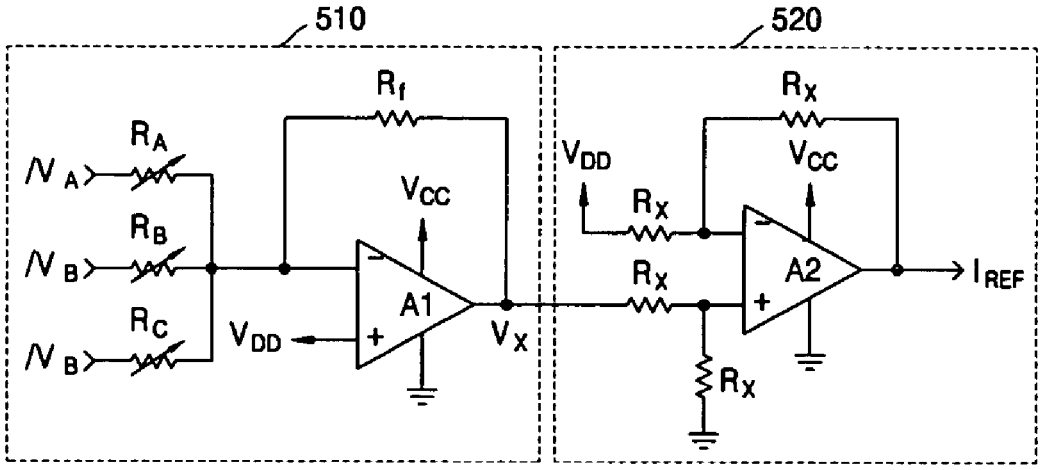
FIG. 5 is a diagram of an exemplary structure of a circuit for generating a reference current applied to the present invention.

A specific circuit for generating analog reference currents is shown in FIG. 5.

As shown in FIG. 5, the circuit for generating analog reference currents comprises a weight adder 510 and a subtracter 520.

Figure 1:
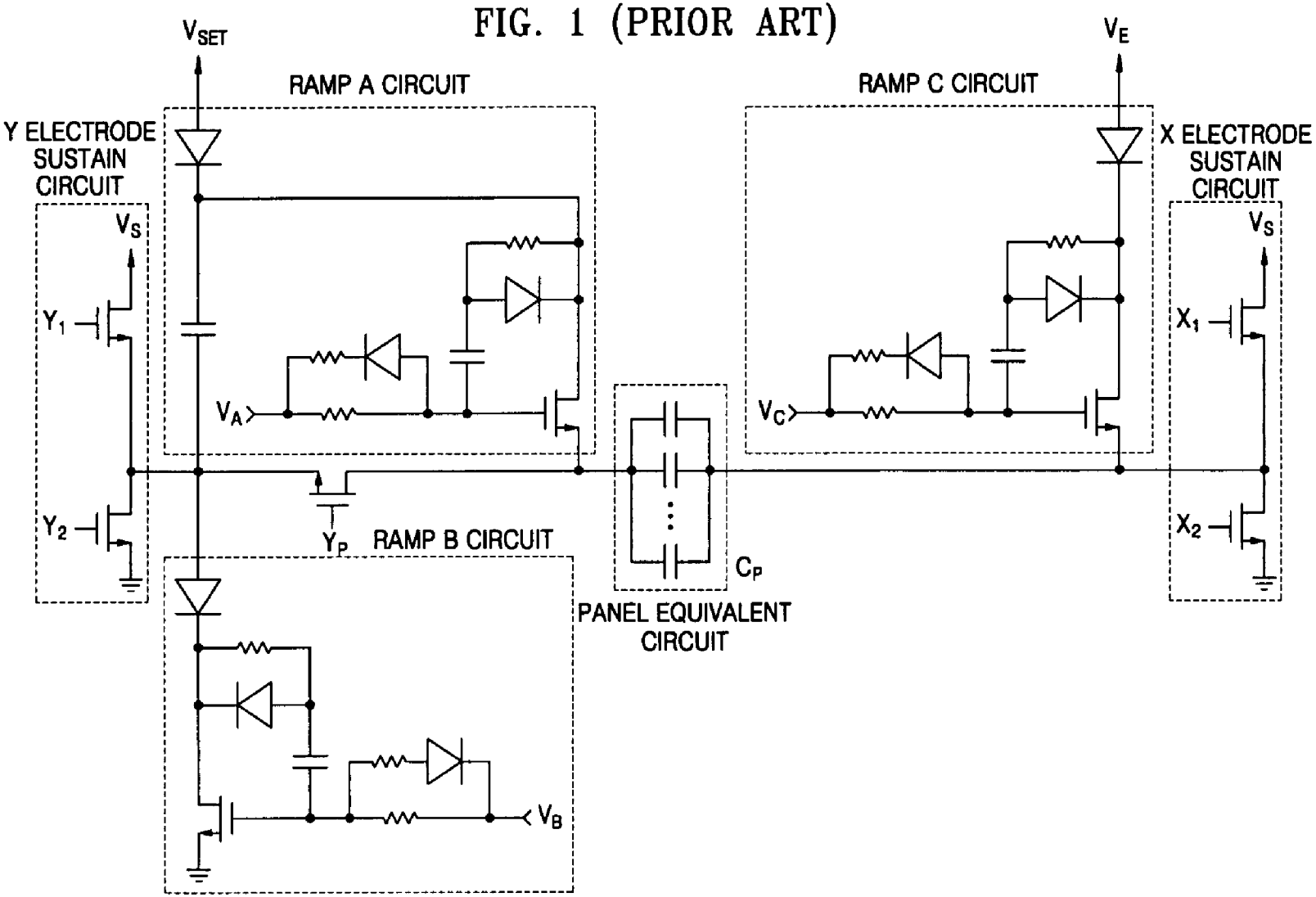
FIG. 1 (PRIOR ART)
FIG. 1 is a schematic diagram of the structure of a plasma display panel driving system according to the prior art.

Ramp generation signals $V_A$, $V_B$ and $V_C$ drive MOSFETs of ramp circuits A, B, and C, respectively in the conventional display panel driving circuit shown in FIG. 1. In the present invention, as shown in FIG. 5,/$V_A$,/$V_B$ and /$V_C$ that are the NOT value of $V_A$, $V_B$ and $V_C$ are applied as inputs to the reference current generation circuit. Also, as an example, the high level of these signals is set to 5V ($V_{DD}$), and 15V ($V_{CC}$) that is higher than $V_{DD}$ is used as the power source of the OP amps.

Then, output $V_X$ of OP amp A1 is expressed as the following Equation 1:

$$v_X = V_{DD} + \frac{R_f}{R_A}(V_{DD} - \overline{V}_A) + \frac{R_f}{R_B}(V_{DD} - \overline{V}_B) + \frac{R_f}{R_C}(V_{DD} - \overline{V}_C) \quad (1)$$

In the remaining intervals, except the reset period,/$V_A$,/$V_B$ and /$V_C$ are designed to be $V_{DD}$. Accordingly, in the remaining intervals, except the reset period, all the values in the brackets in Equation 1 become 0 and the same offset voltage as $V_{DD}$ is output from OP amp A1. In order to remove this offset voltage, the subtracter 520 is used.

Output $I_{REF}$ of OP amp A2 of the subtracter 520 is expressed as the following Equation 2:

$$I_{REF} = \frac{R_f}{R_A}(V_{DD} - \overline{V}_A) + \frac{R_f}{R_B}(V_{DD} - \overline{V}_B) + \frac{R_f}{R_C}(V_{DD} - \overline{V}_C) \quad (2)$$

As can be seen in Equation 2, if a ramp generation signal is applied, all the remaining bracket terms, except the bracket term corresponding to the ramp generation signal, become zero (0), and the only remaining term is a function of only a resistance which determines the slope of the corresponding ramp waveform. For example, if a ramp B generation signal is applied, the output $I_{REF}$(B) of OP amp A2 is $V_{DD}R_F/R_B$. Accordingly, by adjusting $R_B$, the value of reference current $I_{REF}$(B) for generating the ramp B waveform can be adjusted, and the value of reference current $I_{REF}$(B) is not affected by $R_A$ and $R_C$ at all. Likewise, $I_{REF}$(A) and $I_{REF}$(C) are determined independently by $R_A$ and $R_C$, respectively. Feedback resistance $R_f$ commonly affects $I_{REF}$(A), $I_{REF}$(B) and $I_{REF}$(C) and determines the gain value of the reference current generation circuit.

The specific current source 430 following the reference current can be easily implemented by using a switching converter circuit having an inductor at its output end. Since any one of the output terminals of the current source 430 is not grounded, a switching converter isolated by a transformer is preferred. By using a forward converter satisfying these conditions, the current source can be designed.

Figure 6:
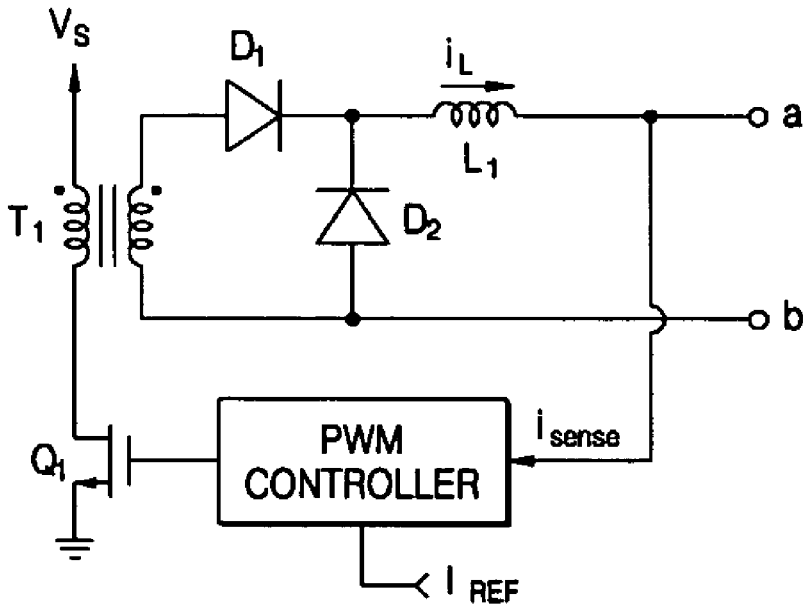
FIG. 6 is a diagram of an exemplary structure of a current source circuit implemented with a forward converter applied to the present invention.

FIG. 6 is a diagram of the structure of a current source circuit implemented by using a forward converter. As shown in FIG. 6, the average current of inductor $L_1$ is controlled to follow reference current $I_{REF}$ by a pulse width modulation (PWM) controller. The peak voltage of a ramp waveform can be adjusted by changing the continuation time of a reference current.

Consistent with the present invention as described above, by using a single current source and two switching units in a display panel driving system, a circuit is designed to generate a ramp reset waveform such that the structure of the display driving circuit can be simplified. That is, while the conventional ramp reset waveform generation apparatus requires 3 ramp generation circuits and an additional power source generating $V_E$ and $V_{SET}$, which determine a maximum value of the ramp voltage, an exemplary embodiment of the present invention can be implemented by using one current source and two switching devices changing the direction of a current flow without adding a separate signal. Thus, the number of components can be reduced greatly, which leads to cost reduction, saving printed circuit board (PCB) space, and increasing the reliability of the product.

In addition, since the MOSFET devices used in the present invention operate as switching devices, the problem of heat generation and efficiency degradation caused by the MOSFET devices operating in a linear domain as in the conventional ramp generation circuit can be solved.

Furthermore, though a capacitor filter is not used in the output terminal of the current source, a capacitor of a large capacity is required for the voltage. Accordingly, the current source used in the present invention is implemented by using a current-controlled switching converter such that it does not need to use a capacitor of a large capacity as in the conventional apparatus, and can reduce the number of components and PCB space.

The present invention can be embodied as a method, an apparatus, and a system. When it is embodied as software, elements of the present invention are code segments executing essential functions. Programs or code segments can be stored in a processor readable recording medium, or can be transmitted in a computer data signal coupled with a carrier in a transmission medium or communication networks. The processor readable medium is any medium that can store or transmit information. Examples of the processor readable medium include electronic circuits, semiconductor memory devices, read-only memory (ROM), random-access memory (RAM), flash memory, EEPROM, floppy disks, optical data storage devices, hard discs, optical fiber media, and radio frequency (RF) network. Computer data signals include any signal that can be transmitted through electronic network channels, optical fiber, air, electromagnetic field, and RF networks.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A ramp reset waveform generating apparatus in a display panel driving apparatus for a display panel comprises:

a current source which is connected to a first electrode sustain circuit of the display panel through a first terminal of the current source and generates a current corresponding to a predetermined reference current;

a first switching unit which switches current flow between a second terminal of the current source and a first electrode terminal of the display panel; and a second switching unit which switches current flow between the second terminal of the current source and a second electrode terminal of the display panel, wherein, in a reset period, a ramp reset waveform is generated in the first electrode terminal of the display panel and the second electrode terminal of the display panel by a charge or a discharge process of the display panel by the current generated in the current source according to a predetermined switching sequence.

2. The ramp reset waveform generating apparatus of claim 1, wherein the predetermined reference current is designed so that a level of each of a plurality of ramp generation signals for generating different slopes of a plurality of ramp waveforms is adjusted independently.

3. The ramp reset waveform generating apparatus of claim 1, wherein a circuit for generating the predetermined reference current comprises:

a weight adder which multiplies a plurality of ramp waveform generation signals by respective weights and adds the plurality of ramp waveform generation signals;

and a subtracter which subtracts an offset voltage from the output signal of the weight adder.

4. The ramp reset waveform generation apparatus of claim 3, wherein the weight adder comprises a first operational amplifier (OP amp) and first resistors and the subtracter comprises a second operational amplifier (OP amp) and second resistors.

5. The ramp reset waveform generation apparatus of claim 1, wherein the current source is implemented by a switching converter circuit isolated by a transformer.

6. The ramp reset waveform generation apparatus of claim 5, wherein, in the predetermined switching sequence, a current path is set so that, in a rising ramp waveform generation period of the first electrode terminal of the display panel in the reset period, a predetermined voltage is applied to the first electrode terminal of the display panel by the first electrode sustain circuit; while the second electrode terminal of the display panel is grounded by the second sustain circuit, the first switching unit is switched ON to allow current flow and the second switching unit is switched OFF; and the display panel is charged in proportion to the current provided to the first electrode terminal of the display panel by the current source so that a first electrode terminal voltage of the display panel increases linearly.

7. The ramp reset waveform generation apparatus of claim 5, wherein, in the predetermined switching sequence, a current path is set so that, in a falling ramp waveform generation period of the first electrode terminal of the display panel, while the second electrode terminal of the display panel is maintained at a predetermined voltage by the second electrode sustain circuit, the first switching unit is switched OFF and the second switching unit is switched ON to allow current flow, and the display panel is discharged through the first electrode terminal of the display panel in proportion to the current provided by the current source so that a first electrode terminal voltage of the display panel decreases linearly.

8. The ramp reset waveform generation apparatus of claim 5, wherein, in the predetermined switching sequence, a current path is set so that, in a rising ramp waveform generation period of the second electrode terminal of the display panel in the reset period, while the first electrode terminal of the display panel is grounded by the first electrode sustain circuit, the first switching unit is switched OFF and the second switching unit is switched ON to allow current flow, and the display panel is charged in proportion to the current provided by the current source so that a second electrode terminal voltage of the display panel increases linearly.

9. A method for designing a plurality of ramp waveform generation apparatuses used in a reset interval of a display panel driving apparatus of a display panel, the design method comprising:

arranging a current source for generating a current corresponding to a reference current, and a plurality of switching devices for determining a flow path of a current generated in the current source in the circuit of the display panel driving apparatus;

determining a current flow path so that, during a predetermined ramp waveform generation period, charging or discharging the display panel occurs by the current generated in the current source according to a predetermined switching sequence such that a ramp voltage is generated in a first electrode or in a second electrode of the display panel.

10. The design method of claim 9, wherein the reference current is designed so that a level of each of a plurality of ramp generation signals for generating different slopes of a plurality of ramp waveforms is adjusted independently.

11. The design method of claim 9, wherein the current source is implemented by a switching converter circuit isolated by a transformer.

12. The design method of claim 9, wherein, in the predetermined switching sequence, a current path is set so that, in a rising ramp waveform generation period of the first electrode of the display panel in the reset period, while a predetermined voltage is applied to the first electrode of the display panel and the second electrode of the display panel is grounded, the display panel is charged in proportion to the current provided to the first electrode of the display panel by the current source so that a first electrode voltage of the display panel increases linearly.

13. The design method of claim 9, wherein, in the predetermined switching sequence, a current path is set so that, in a falling ramp waveform generation period of the first electrode of the display panel in the reset period, while the second electrode of the display panel is maintained at a predetermined voltage the display panel is discharged through the first electrode of the display panel in proportion to the current provided by the current source so that a first electrode voltage of the display panel decreases linearly.

14. The design method of claim 9, wherein, in the predetermined switching sequence, a current path is set so that, in a rising ramp waveform generation interval of the second electrode of the display panel in the reset period, while the first electrode of the display panel is grounded by the first electrode sustain circuit, the display panel is charged in proportion to the current provided by the current source so that a second electrode voltage of the display panel increases linearly.

* * * * *